US011751295B2

(12) United States Patent
Hu et al.

(10) Patent No.: US 11,751,295 B2
(45) Date of Patent: Sep. 5, 2023

(54) CONVECTION SYSTEM FOR AN OVEN

(71) Applicant: WHIRLPOOL CORPORATION, Benton Harbor, MI (US)

(72) Inventors: Hanks Hu, Shenzhen (CN); Benny Huang, Guangzhou (CN); Youcheng Huang, Shenzhen (CN); Ryan Li, Shenzhen (CN); Ping Wu, Shenzhen (CN)

(73) Assignee: Whirlpool Corporation, Benton Harbor, MI (US)

( * ) Notice: Subject to any disclaimer, the term of this patent is extended or adjusted under 35 U.S.C. 154(b) by 255 days.

(21) Appl. No.: 17/179,710

(22) Filed: Feb. 19, 2021

(65) Prior Publication Data

US 2022/0272800 A1 Aug. 25, 2022

(51) Int. Cl.
*H05B 6/64* (2006.01)
*F24C 15/32* (2006.01)

(52) U.S. Cl.
CPC ..... *H05B 6/6473* (2013.01); *F24C 15/325* (2013.01); *H05B 6/6494* (2013.01); *H05B 2203/013* (2013.01)

(58) Field of Classification Search
CPC . F24C 15/325; H05B 2203/013; H05B 3/141; H05B 3/145; H05B 3/62; H05B 6/6402; H05B 6/6473; H05B 6/6494
See application file for complete search history.

(56) References Cited

U.S. PATENT DOCUMENTS

| | | | | |
|---|---|---|---|---|
| 5,272,302 | A * | 12/1993 | Dudley | H05B 6/6402 219/744 |
| 6,864,468 | B2 | 3/2005 | Kim et al. | |
| 7,271,373 | B2 * | 9/2007 | Oh | H05B 6/6473 219/746 |
| 2009/0272728 | A1 * | 11/2009 | Abbott | H05B 3/68 219/399 |
| 2013/0264337 | A1 | 10/2013 | Lee | |

FOREIGN PATENT DOCUMENTS

| | | | |
|---|---|---|---|
| CN | 1280585 | C | 10/2006 |
| CN | 205261663 | U | 5/2016 |
| DE | 4413252 | A1 | 10/1995 |
| DE | 60311411 | T2 | 10/2007 |
| DE | 102018104988 | A1 | 9/2019 |
| EP | 0852317 | B1 | 10/2003 |
| EP | 1441567 | B1 | 1/2007 |

(Continued)

*Primary Examiner* — Dana Ross
*Assistant Examiner* — Joe E Mills, Jr.
(74) *Attorney, Agent, or Firm* — Brooks Kushman P.C.

(57) ABSTRACT

An oven includes a plurality of walls, a fan, and a heating element. The plurality of walls defines an internal cavity in which food may be placed for cooking. A first of the plurality of walls defines a plurality of orifices that establishes fluid communication between the internal cavity and a fluid path. The fan is configured to direct air from the fluid path, through the plurality of orifices, and into the internal cavity. The heating element is disposed on the first of the plurality of walls and adjacent to the plurality of orifices. The heating element is configured to heat the air being directed from the fluid path, through the plurality of orifices, and into the internal cavity.

20 Claims, 4 Drawing Sheets

(56) References Cited

FOREIGN PATENT DOCUMENTS

| | | | |
|---|---|---|---|
| ES | 2279026 | T3 | 7/2004 |
| KR | 930001578 | Y1 | 4/1993 |
| KR | 200189093 | Y1 | 7/2000 |
| KR | 100437402 | B1 | 6/2004 |
| KR | 20040067380 | A | 7/2004 |
| WO | 2013148238 | A1 | 10/2013 |

* cited by examiner

CONVECTION SYSTEM FOR AN OVEN

TECHNICAL FIELD

The present disclosure relates to an appliance that is configured to cook food, such as an oven or a microwave oven.

BACKGROUND

Ovens may have a convection cooking feature that is configured to heat air being introduced into a cooking cavity within the oven.

SUMMARY

An oven includes a plurality of walls, a fan, and a heating element. The plurality of walls defines an internal cavity in which food may be placed for cooking. A first of the plurality of walls defines a plurality of orifices that establishes fluid communication between the internal cavity and a fluid path. The fan is configured to direct air from the fluid path, through the plurality of orifices, and into the internal cavity. The heating element is disposed on the first of the plurality of walls and adjacent to the plurality of orifices. The heating element is configured to heat the air being directed from the fluid path, through the plurality of orifices, and into the internal cavity.

An oven includes a wall, a fan, and a heating element. The wall defines a cavity configured to receive food for cooking, a channel on an opposing side of the wall relative to the cavity, and at least one aperture configured to establish fluid communication between the cavity and the channel. The fan is configured direct air from the channel and into the cavity via the at least one aperture. The heating element overlays the wall adjacent to the at least one aperture. The heating element is configured to heat air that is being directed through the at least one aperture.

An oven includes a plurality of walls, a fan, a microwave generating device, and a heating element. The plurality of walls defines an internal cavity in which food may be placed for cooking, a first pathway that is at least partially defined on an opposing side of the plurality of walls relative to the internal cavity, and a second pathway that is at least partially defined on an opposing side of the plurality of walls relative to the internal cavity. A first of the plurality of walls defines a at least one orifice that establishes fluid communication between the internal cavity and the first pathway. A second of the plurality of walls defines a plurality of orifices that establishes fluid communication between the internal cavity and the second pathway. The microwave generating device is configured to direct microwaves from the first pathway, through the at least one orifice, and into the internal cavity. The fan is configured to direct air from the second pathway, through the plurality of orifices, and into the internal cavity. The heating element is disposed on the second of the plurality of walls and adjacent to the plurality of orifices. The heating element is configured to heat the air being directed from the second pathway, through the plurality of orifices, and into the internal cavity via the fan.

DETAILED DESCRIPTION

Figure 1:
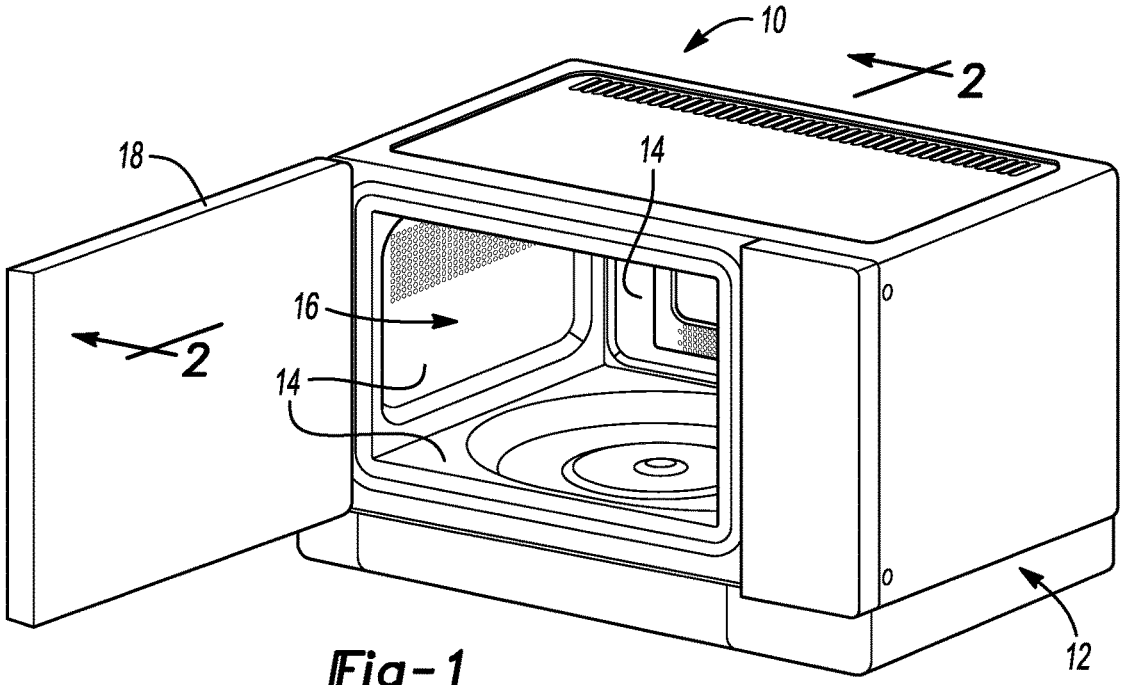
FIG. 1 is a front isometric view of a microwave oven.
Figure 3:
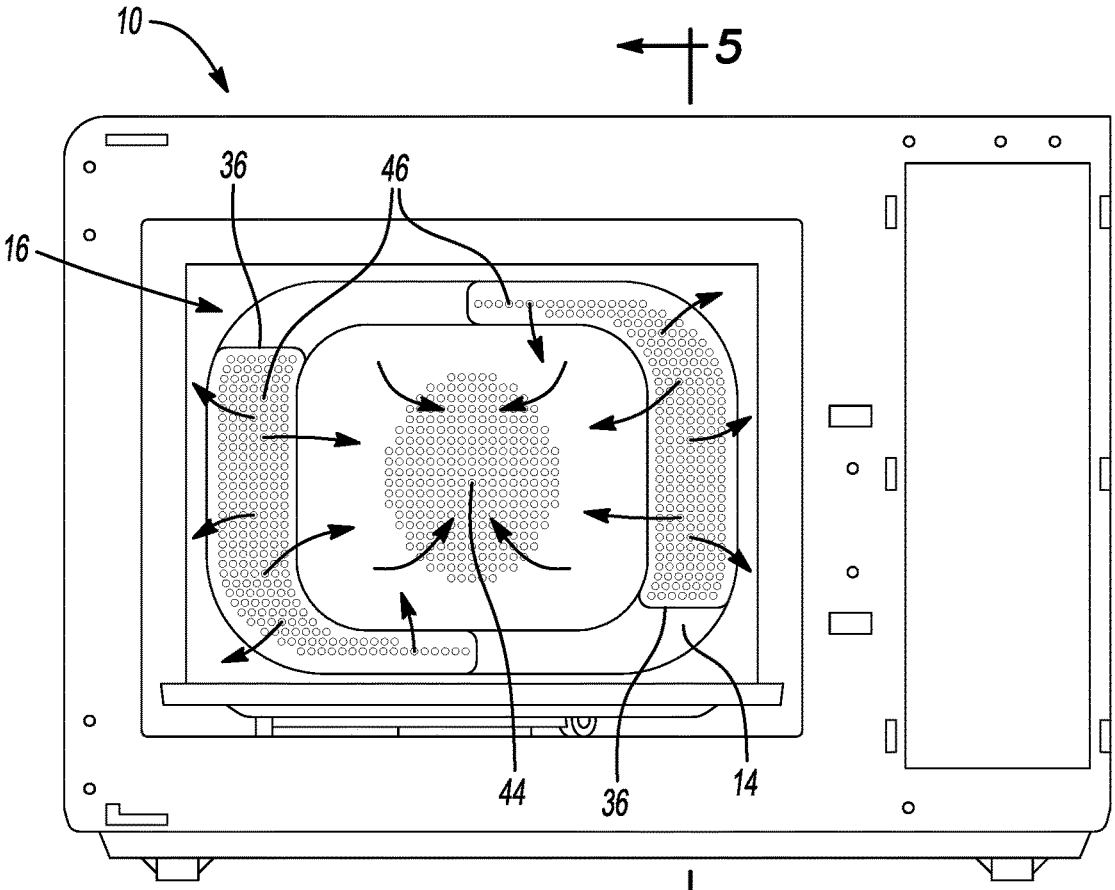
FIG. 3 is a front view of the microwave oven with the door of the microwave removed.
Figure 2:
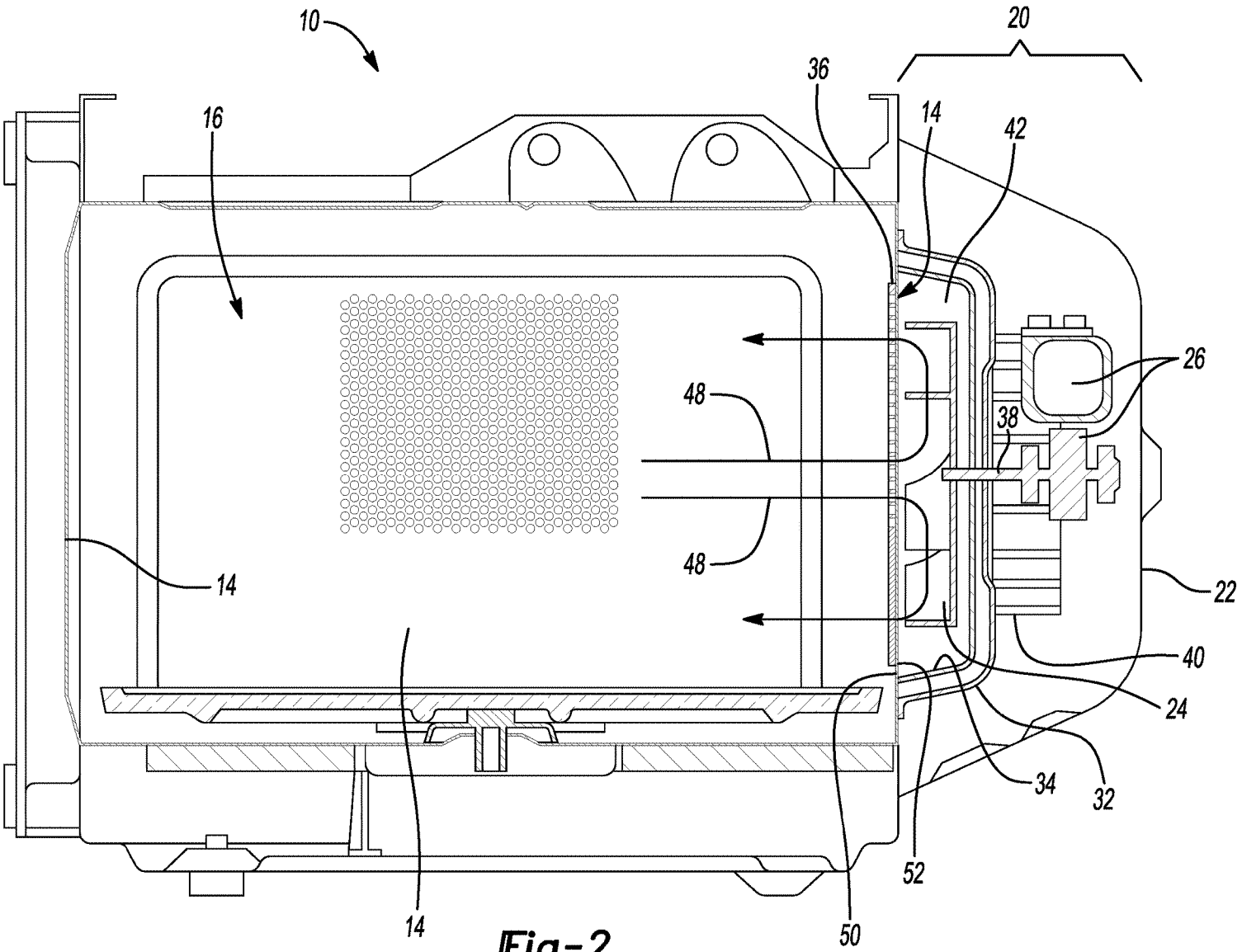
FIG. 2 is a cross-sectional view taken along line 2-2 in FIG. 1.
Figure 4:
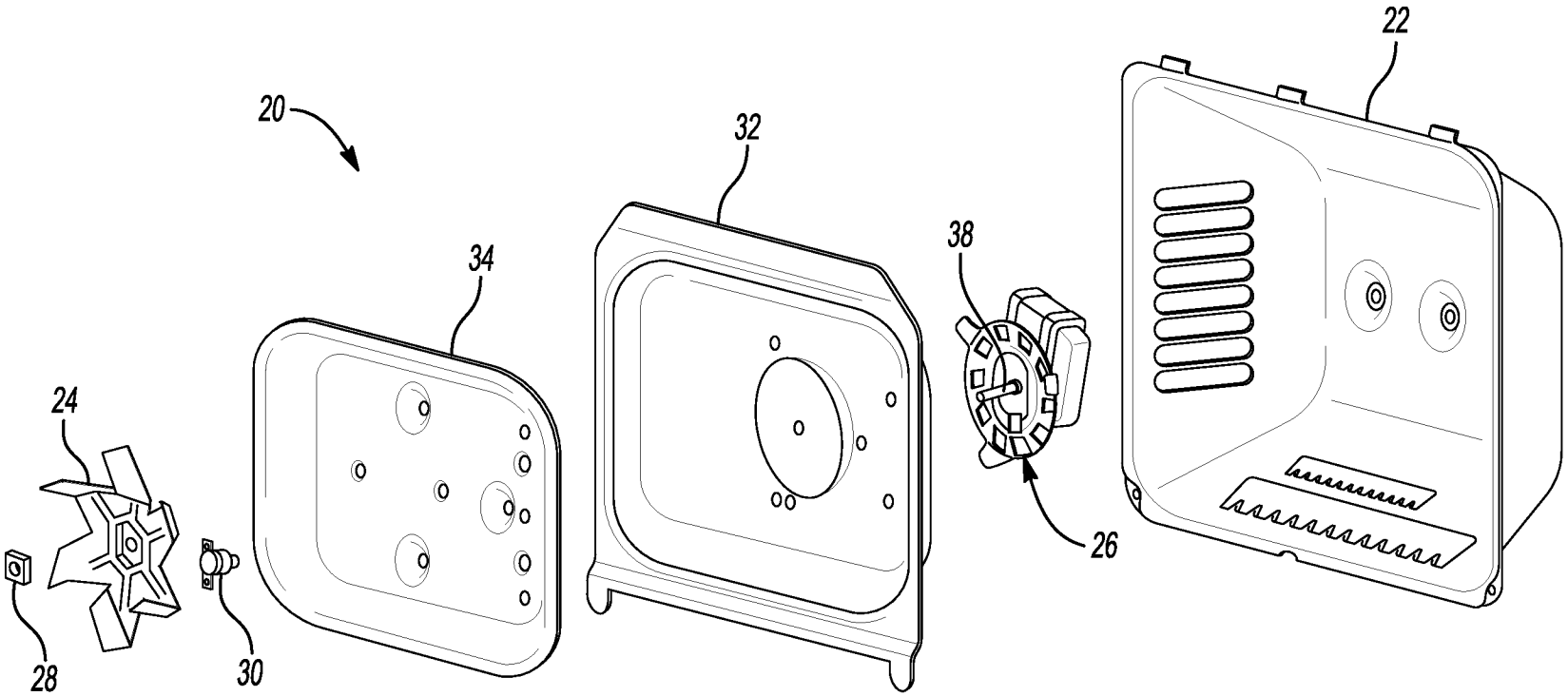
FIG. 4 is an exploded view of a convection system assembly.
Figure 5:
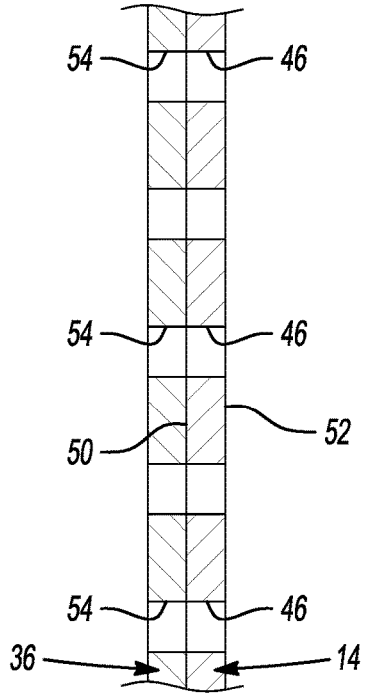
FIG. 5 is a partial cross-sectional view of an internal wall of the microwave oven that is adjacent to the convection system assembly taken along line 5-5 in FIG. 3.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

As referenced in the figures, the same reference numerals may be used herein to refer to the same parameters and components or their similar modifications and alternatives. For purposes of description herein, the terms "upper," "lower," "right," "left," "rear," "front," "vertical," "horizontal," and derivatives thereof shall relate to the present disclosure as oriented in FIG. 1. However, it is to be understood that the present disclosure may assume various alternative orientations, except where expressly specified to the contrary. It is also to be understood that the specific devices and processes illustrated in the drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. The drawings referenced herein are schematic and associated views thereof are not necessarily drawn to scale.

Referring to FIG. 1, a front isometric view of a microwave oven 10 is illustrated. The microwave oven 10 includes a housing 12. The housing includes a plurality of walls 14 that define an internal cavity 16 in which food may be placed for cooking. The plurality of walls 14 may include a top wall, a bottom wall, and three side walls. The microwave oven 10 also includes a door 18 that is rotatably attached to the housing 12.

Referring to FIGS. 2-5, the microwave oven 10 and a convection system 20 of the microwave oven 10 are illustrated in further detail. The convection system 20 may include a housing 22 that connects the convection system 20 to one of the plurality of walls 14. It should be noted that although the figures illustrate that the convection system 20 is connected to a side wall of the plurality of walls 14, the convection system 20 may be connected to any of the plurality of walls 14, including the top wall, the bottom wall, or any of the side walls. The convection system 20 includes a fan 24 that is powered by a motor 26, such as an electric motor. The fan 24 may be secured to the motor 26 by a fastener 28 and a connector 30. In addition, the convection system 20 may include a plate 32 and a heat shield 34 for containing the heat generated by one or more heating elements 36. The plate 32 and the heat shield 34 separate the motor 26 from the fan 14 and the one or more heating elements 36. More specifically, the plate 32 and the heat shield 34 may be configured to prevent or reduce any heat from being transferred from the one or more heating elements 36 to the motor 26. The plate 32 and the heat shield 34 may define openings through which a post 38 of the motor 26 extends so that the fan 24 may be connected to the post. A secondary fan 40 (not shown in FIG. 4) may be secured to the electric motor 26 on an opposing side of the plate 32 and a heat shield 34. The secondary fan 40 may be configured to cool the motor 26.

A first wall of the plurality of walls 14, (i.e., the wall that the convection system 20 is secured to) defines a first pathway, channel, or fluid path 42 on an opposing side of the first wall of the plurality of walls 14 relative to the internal cavity 16. The first fluid path 42 may more specifically be defined between the first wall of the plurality of walls 14 and the plate 32 or heat shield 34. The first wall 14 may define a first plurality of orifices 44 that establishes fluid communication between the internal cavity 16 and the first fluid path 42. The first of the plurality of orifices 44 may collectively form one or more air inlets from the internal cavity 16 to the fluid path 42. The first wall of the plurality of walls 14 may also define a second plurality of orifices 46 that establishes fluid communication between the internal cavity 16 and the first fluid path 42. The second of the plurality of orifices 46 may collectively form one or more air outlets from the first fluid path 42 to the internal cavity 16.

More specifically, the fan 24 may configured to draw air into the first fluid path 42 from the internal cavity 16 via the first plurality of orifices 44, and may be configured to direct air out of the first fluid path 42 and into the internal cavity 16 via the second plurality of orifices 46. The first plurality of orifices 44 and the second plurality of orifices 46 may alternatively be referred to as a plurality of apertures or at least one orifice or aperture. The one or more heating elements 36 are configured to heat the air as the air is being directed out of the first fluid path 42 and into the internal cavity 16 via the second plurality of orifices 46. The internal cavity 16, the first plurality of orifices 44, the first fluid path 42, and the second plurality of orifices 46 may collectively form and define at least one convection pathway 48 where the air circulates between the internal cavity 16 and the first fluid path 42 via the fan 24, and where the air is heated as the air is directed across the one or more heating elements 36.

The one or more heating elements 36 may be disposed on the first wall (or a portion of the first wall) of the plurality of walls 14 (i.e., the wall that the convection system 20 is secured to) and may be adjacent to the second plurality of orifices 46. More specifically, the one or more heating elements 36 may overlay the first of the plurality of walls 14 adjacent to the second plurality of orifices 46. The one or more heating elements 36 may be disposed on (or overlay) a first surface 50 of the first of the plurality of walls 14, which faces the internal cavity 16 (as shown). Alternatively, the one or more heating elements 36 may be disposed on (or overlay) a second surface 52 of the first of the plurality of walls 14, which faces the first fluid path 42. The one or more heating elements 36 may define a third plurality of orifices 54 that are aligned with the second plurality of orifices 46 or at least a portion of the second plurality of orifices 46.

Each of the one or more heating elements 36 may be a coating that is disposed over (or overlays) the first wall (or a portion of the first wall) of the plurality of walls 14. More specifically, the one or more heating elements 36 may be made from any type of resistive material, including, but not limited to, a metallic resistive material, graphene, nano graphene, tin oxide, etc. The resistive material may be deposited on the first wall of the plurality of walls 14 via any known additive manufacturing process (e.g., any three-dimensional printing process such as metal sintering).

Once the one or more heating elements 36 have been secured to the first wall of the plurality of walls 14, the one or more heating elements 36 may be hardened via a heat-treating process. The coating that forms the one or more heating elements 36 may be deposited over one or more portions of the wall that defines the second plurality of orifices 46. The coating that forms the one or more heating elements 36 may specifically define the third plurality of orifices 54 that are aligned with the second plurality of orifices 46 or at least a portion of the second plurality of orifices 46.

In additional to the one or more heating elements 36 of the convection system 20, additional heating elements may be disposed on one or more of the remainder of plurality of the walls 14. These additional heating elements may be disposed on surfaces of the plurality of walls 14 that face inward toward the internal cavity 16 and may operate to perform a baking operation or may operation in conjunction with the one or more heating elements 36 to perform a convectional baking operation. These additional heating elements may be disposed on any of the walls of the plurality of walls 14 in any configuration. For example, the additional heating elements may be disposed on any of the side walls, the top wall, or the bottom wall in any combination.

Figure 6:
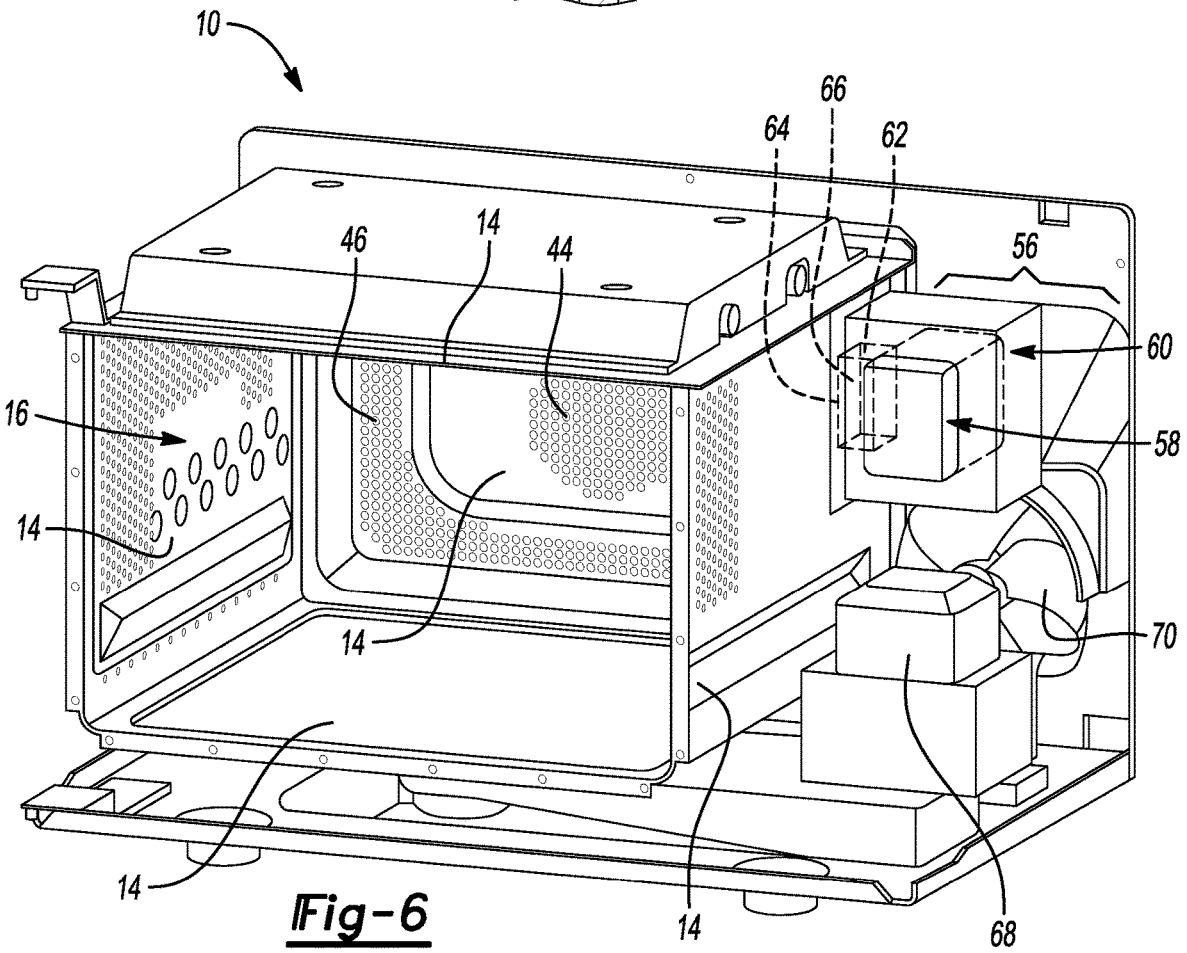
FIG. 6 is a front isometric view of a microwave oven with the outer panels removed.

Referring now to FIG. 6, a microwave cooking system 56 of the microwave oven 10 is illustrated. It should be noted that although the figures illustrate that portions the microwave cooking system 56 are connected to a side wall of the plurality of walls 14, the microwave cooking system 56 may be connected to any of the plurality of walls 14, including the top wall, the bottom wall, or any of the side walls.

The microwave cooking system 56 includes a microwave generating device 58, such as a magnetron or a solid-state device. The microwave cooking system 56 includes a waveguide 60 that defines a second pathway, channel, or fluid path 62 on an opposing side of a second wall of the plurality of walls 14 relative to the internal cavity 16. The second wall of the plurality of walls 14 may define an orifice 64 that establishes fluid communication between the internal cavity 16 and the second fluid path 62. A waveguide cover 66 may be disposed over the orifice 64 within the internal cavity 16. The second fluid path 62 of the waveguide 60 is configured to direct microwaves from the microwave generating device 58, through the waveguide cover 66, and to the internal cavity 16 in order to cook any food that is disposed within the internal cavity 16.

The microwave cooking system 56 may also include a power supply 68, such as a transformer, that provides electrical power to the microwave generating device 58, a capacitor (not shown), and a cooling fan 70. The cooling fan 70 may be configured to cool the various components of the microwave cooking system 56, such as the microwave generating device 58, power supply 68, capacitor, etc. Please note that for illustrative purposes, the electrical connections between the various components of the microwave cooking system 56 and the electrical connection between the microwave 10 and an external power source (e.g., an electrical plug and outlet connection) are not shown.

The electronic components (e.g., microwave generating device 58, heating elements, fan motors, power supply 68, capacitors, etc.) of the microwave cooking system 56, convection system 20, and any other electrical component may be connected to a control panel, such as a human machine interface (HMI), and a controller, so that an operator may control various parameters. For example, the operator may be configured to input a cooking time, cooking temperature, what mode of cooking is desired (i.e., microwave cooking, convection cooking, baking, or any combination thereof), etc.

The controller may be part of a larger control system and may be controlled by various other controllers throughout the microwave oven 10. It should therefore be understood that the controller and one or more other controllers can collectively be referred to as a "controller" that controls various functions or components of the microwave oven 10 in response to signals from various sensors to control the various functions or components of the microwave oven 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the microwave oven 10.

Although a microwave oven is illustrated herein, it should be understood that the convection system 20 described herein, including the one or more heating elements 36, may be utilized in any type of oven system. For example, the convection system 20 described herein may be utilized in a conventional baking oven that includes a convection system, a toaster oven that includes a convection system, etc.

It should further be understood that the designations of first, second, third, fourth, etc. for any component, state, or condition described herein may be rearranged in the claims so that they are in chronological order with respect to the claims. For example, the first plurality of orifices 44, the second plurality of orifices 46, or the third plurality of orifices 54 may each be referred to as the first plurality of orifices 44, the second plurality of orifices 46, or the third plurality of orifices 54 depending on the chronological order within the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. An oven comprising:

a plurality of walls defining an internal cavity in which food may be placed for cooking, wherein a first of the plurality of walls defines a plurality of orifices that establish fluid communication between the internal cavity and a fluid path;

a fan configured to direct air from the fluid path, through the plurality of orifices, and into the internal cavity; and a heating element disposed (Lon the first of the plurality of walls, (ii) within the internal cavity, and (iii) adjacent to the plurality of orifices, wherein the heating element is configured to generate heat and transfer the heat to the air being directed from the fluid path, through the plurality of orifices, and into the internal cavity.

2. The oven of claim 1, wherein the heating element defmes a second plurality of orifices that are aligned with the plurality of orifices.

3. The oven of claim 1, wherein the heating element is a coating that is disposed over a portion of the first of the plurality of walls.

4. The oven of claim 3, wherein the portion of the first of the plurality of walls defines the plurality of orifices.

5. The oven of claim 4, wherein the coating defmes a second plurality of orifices that are aligned with the plurality of orifices.

6. An oven comprising:

a wall defining, a cavity configured to receive food for cooking, a channel on an opposing side of the wall relative to the cavity, and at least one aperture configured to establish fluid communication between the cavity and the channel;

a fan configured direct air from the channel and into the cavity via the at least one aperture; and a heating element (i) overlaying the wall adjacent to the at least one aperture and (ii) disposed within the cavity, wherein the heating element is configured to generate heat and transfer the heat to air that is being directed through the at least one aperture.

7. The oven of claim 6, wherein the heating element is a coating that is disposed over a portion of the wall.

8. The oven of claim 7, wherein the portion of the wall defines the at least one aperture.

9. The oven of claim 6, wherein the heating element defines one or more orifices that are aligned with the at least one aperture.

10. A microwave oven comprising:

a plurality of walls defining, an internal cavity in which food may be placed for cooking, a first pathway that is at least partially defined on an opposing side of the plurality of walls relative to the internal cavity, and a second pathway that is at least partially defined on an opposing side of the plurality of walls relative to the internal cavity, wherein a first of the plurality of walls defines at least one orifice that establishes fluid communication between the internal cavity and the first pathway, and wherein a second of the plurality of walls defines a plurality of orifices that establishes fluid communication between the internal cavity and the second pathway;

a microwave generating device configured to direct microwaves from the first pathway, through at least one orifice, and into the internal cavity;

a fan configured to direct air from the second pathway, through the plurality of orifices, and into the internal cavity; and a heating element disposed (i) on the second of the plurality of walls, (ii) within the internal cavity, and (iii) adjacent to the plurality of orifices, wherein the heating element is configured to generate heat and transfer the heat to the air being directed from the second pathway, through the plurality of orifices, and into the internal cavity via the fan.

11. The microwave oven of claim 10, wherein the heating element defines a second plurality of orifices that are aligned with the plurality of orifices.

12. The microwave oven of claim 10, wherein the heating element is a coating that is disposed over a portion of the second of the plurality of walls.

13. The microwave oven of claim 12, wherein the portion of the second of the plurality of walls defines the plurality of orifices.

14. The microwave oven of claim 13, wherein the coating defines a second plurality of orifices that are aligned with the second plurality of orifices.

15. The oven of claim 1, wherein the heating element is an electrical resistive heating element.

16. The oven of claim 1 further comprising a second heating element disposed (i) on the first of the plurality of walls, (ii) within the internal cavity, and (iii) adjacent to the plurality of orifices, wherein the heating element is configured to generate heat and transfer the heat to the air being directed from the fluid path, through the plurality of orifices, and into the internal cavity.

17. The oven of claim 6, wherein the heating element is an electrical resistive heating element.

18. The oven of claim 6 further comprising a second heating element (i) overlaying the wall adjacent to the at least one aperture and (ii) disposed within the cavity, wherein the heating element is configured to generate heat and transfer the heat to air that is being directed through the at least one aperture.

19. The microwave oven of claim 10, wherein the heating element is an electrical resistive heating element.

20. The microwave oven of claim 10 further comprising a second heating element disposed (i) on the second of the plurality of walls, (ii) within the internal cavity, and (iii) adjacent to the plurality of orifices, wherein the heating element is configured to generate heat and transfer the heat to the air being directed from the second pathway, through the plurality of orifices, and into the internal cavity via the fan.

* * * * *